US005165643A

United States Patent [19]

Shreiner

[11] Patent Number: 5,165,643

[45] Date of Patent: Nov. 24, 1992

[54] ERGONOMIC HANDRAIL

[75] Inventor: Thomas A. Shreiner, Muncy, Pa.

[73] Assignee: Construction Specialties, Inc., Cranford, N.J.

[21] Appl. No.: 679,802

[22] Filed: Apr. 3, 1991

[51] Int. Cl.[5] ..... E04H 17/14

[52] U.S. Cl. ..... 248/251; 248/345.1; 256/59

[58] Field of Search ..... 248/251, 346.1; 52/716; 256/59, 65, 67, 68

[56] References Cited

U.S. PATENT DOCUMENTS 4,200,261 4/1980 Bartlett ..... 256/59
4,353,529 10/1982 Brown ..... 256/59

OTHER PUBLICATIONS

Sheet from 1990 Catalog of Balco, Inc.
Sheet from 1990 Catalog of Brown Mfg. Co.
Sheet from 1990 Catalog of Pawling Corp.

*Primary Examiner*—Robert W. Gibson, Jr.
*Attorney, Agent, or Firm*—Brumbaugh, Graves, Donohue & Raymond

[57] ABSTRACT

An ergonomic handrail adapted to be mounted on a wall in spaced-apart relation therefrom by means of mounting brackets and comprises an elongated metal retainer of substantially uniform cross-section along its length and having a channel-shaped body portion, upper and lower flange portions extending upwardly and downwardly, respectively, from the body portion, a web portion extending upwardly from the body portion from a juncture therewith rearwardly of the upper flange portion and defining with the upper flange portion a slot that opens generally upwardly, and front and rear arcuate arm portions extending upwardly from a common juncture with an upper edge of the web portion and defining the major portion of substantially circular cylindrical surface except for a space between upper edges thereof. An elongated bumper cover member of an impact resistant substantially rigid polymeric material and of substantially uniform cross-section along its length is received on the retainer. The bumper cover member includes a front web portion, an upper flange portion of substantially L-shaped cross section received in captured engagement by the upper flange portion of the retainer with a return leg part thereof received in the slot, and a lower flange portion of substantially L-shaped cross section received in captured engagement by the lower flange portion of the retainer. An elongated handgrip cover member of an impact-resistant substantially rigid polymeric material is received over the upper arm portions of the retainer in substantially continuous contact therewith along mutually engageable internal surfaces of the handgrip cover member and external surfaces of the arm portions of the retainer.

6 Claims, 2 Drawing Sheets

ERGONOMIC HANDRAIL

BACKGROUND OF THE INVENTION

For almost 20 years, Construction Specialties, Inc., the assignee of the present invention, has been marketing a line of wall protection products under the trademark "Acrovyn ®." The line currently includes several styles of handrails, bumper guards, corner guards and crash rails, all of which have either continuous metal retainers or metal mounting clips or brackets that are attached to a wall and that receive cover members of an impact resistant, substantially rigid polymeric material. In most of the "Acrovyn ®" products, the cover members are mounted on the retainers or clips in a manner such they can deflect and deform under impacts from objects carried or rolled near to them. The deflection and deformation of the cover members absorb some of the energy of the impact, which prevents damage to the underlying wall. The "Acrovyn ®" handrails not only fulfill the function of protecting the walls on which they are mounted but provide support for persons walking through the building; thus, they are widely used in hospitals and nursing homes, places where equipment carts, food carts, wheelchairs and patient litters are constantly moving about and are apt to strike the walls and infirm patients are walking through corridors and other spaces, oftentimes for therapeutic exercise that is important to their speedy recovery, and rely on the handrails for support.

Some styles of "Acrovyn ®" handrails and handrails of similar designs marketed by others have handgrip portions that consist of only semi-cylindrical upper surfaces that lack a defined gripping portion that can be grasped firmly between the fingers and the thumb. Although such handrails are entirely adequate from the point of view of being capable of supporting the infirm patients that use them, they do not provide as secure a grip for the patients as a round rail does. Round rails, on the other hand, present essentially a line of contact to objects that strike them and are more apt to be marred and less able to absorb energy than are the designs that have a wide face, particularly a wide face that is also deformable and deflectable.

Relatively recently, handrails of the type that consist of a metal retainer and an impact-resistant cover member and that combine a generally round handgrip portion and a wide impact portion have been introduced. All of the three designs that the present inventor is aware of have one or more disadvantages. Two of them provide for contact between the cover member and the retainer in the handgrip portion along spaced-apart lines or bands, leaving regions of the cover member that are not well supported. Two of them have handgrip portions that are round in front and along the top but have a corner at the rear that presents an uncomfortable gripping portion for the fingers. One of them has a V-shaped juncture between the handgrip portion and the bumper portion that does not leave enough room for the thumb. One of them has a handgrip portion that is formed by three flat surfaces, which is not ergonomically correct. Two of them have frontal protuberances, which limits the zone for impact absorption and concentrates all marring along a narrow band. All three have a single cover member, which restricts the opportunities for architects and designers to create aesthetic interest by using different colors and shades and also is somewhat limiting on the configurations of the retainer and the cover from a functional point of view, in that the cover and retainer have to be designed to enable the cover to be snapped onto the retainer.

SUMMARY OF THE INVENTION

One object of the present invention is to provide an ergonomic handrail that has a fully rounded handgrip portion and a wide bumper portion spaced sufficiently far below the handrail portion to comfortably accept the thumb, preferably at a frontally concave web portion. Another object is to provide a handrail that meets all current codes and industrial standards, especially those relating to the strength of the handgrip portion. Still a further object is to provide a handrail that affords to architects and interior designers considerable freedom to create interesting aesthetic effects by color variations and decorative accents.

The foregoing and other objects and advantages are attained, according to the present invention, by an ergonomic handrail adapted to be mounted on a wall in spaced-apart relation therefrom by means of mounting brackets. The handrail comprises an elongated metal retainer of substantially uniform cross-section along its length and having a channel-shaped body portion, upper and lower flange portions extending upwardly and downwardly, respectively, from the body portion, and a web portion extending upwardly from the body portion from a juncture therewith rearwardly of the upper flange portion and defining with the upper flange portion a slot that opens generally upwardly. Front and rear arcuate arm portions extend upwardly from a common juncture with an upper edge of the web portion and define the major portion of a substantially circular cylindrical surface except for a space between upper edges thereof. An elongated bumper cover member of an impact resistant, substantially rigid polymeric material and of substantially uniform cross-section along its length is mounted on the retainer. The bumper cover member has a front web portion, an upper flange portion of substantially L-shaped cross section received in captured engagement by the upper flange portion of the retainer with a return leg part thereof received in the slot, and a lower flange portion of substantially L-shaped cross section received in captured engagement by the lower flange portion of the retainer. An elongated handgrip cover member of an impact-resistant, substantially rigid polymeric material is received over the upper arm portions of the retainer in substantially continuous contact therewith along mutually engageable internal surfaces of the handgrip cover member and external surfaces of the arm portions of the retainer.

In a preferred embodiment, the handgrip cover member is substantially tubular except for a space between front and rear edges. The rear arm portion of the retainer has a shoulder on its external surface, the front edge of the handgrip cover member resides closely adjacent the juncture of the web portion of the retainer with the front arm portion of the retainer, and the rear edge of the handgrip cover member engages the shoulder on the rear arm portion of the retainer. The web portion of the retainer has a concave front surface, which affords a comfortable resting place for the thumb of a person who grasps the handgrip portion. Advantageously, at least one cushion member is engaged between the retainer and the web portion of the bumper cover member.

An accent strip can, optionally, be provided coextensively with the front surface of the web portion of the retainer and in engagement therewith. In one form, the accent strip is of a substantially rigid polymeric material and has a lower edge portion received in the slot behind the return leg portion of the upper edge flange portion of the bumper cover member and an upper edge portion received in a groove in the front arm portion of the retainer adjacent the juncture thereof with the web portion.

For a better understanding of the invention, reference may be made to the following description of an exemplary embodiment, taken in conjunction with the accompanying drawings.

DESCRIPTION OF THE EMBODIMENT

Figure 1:
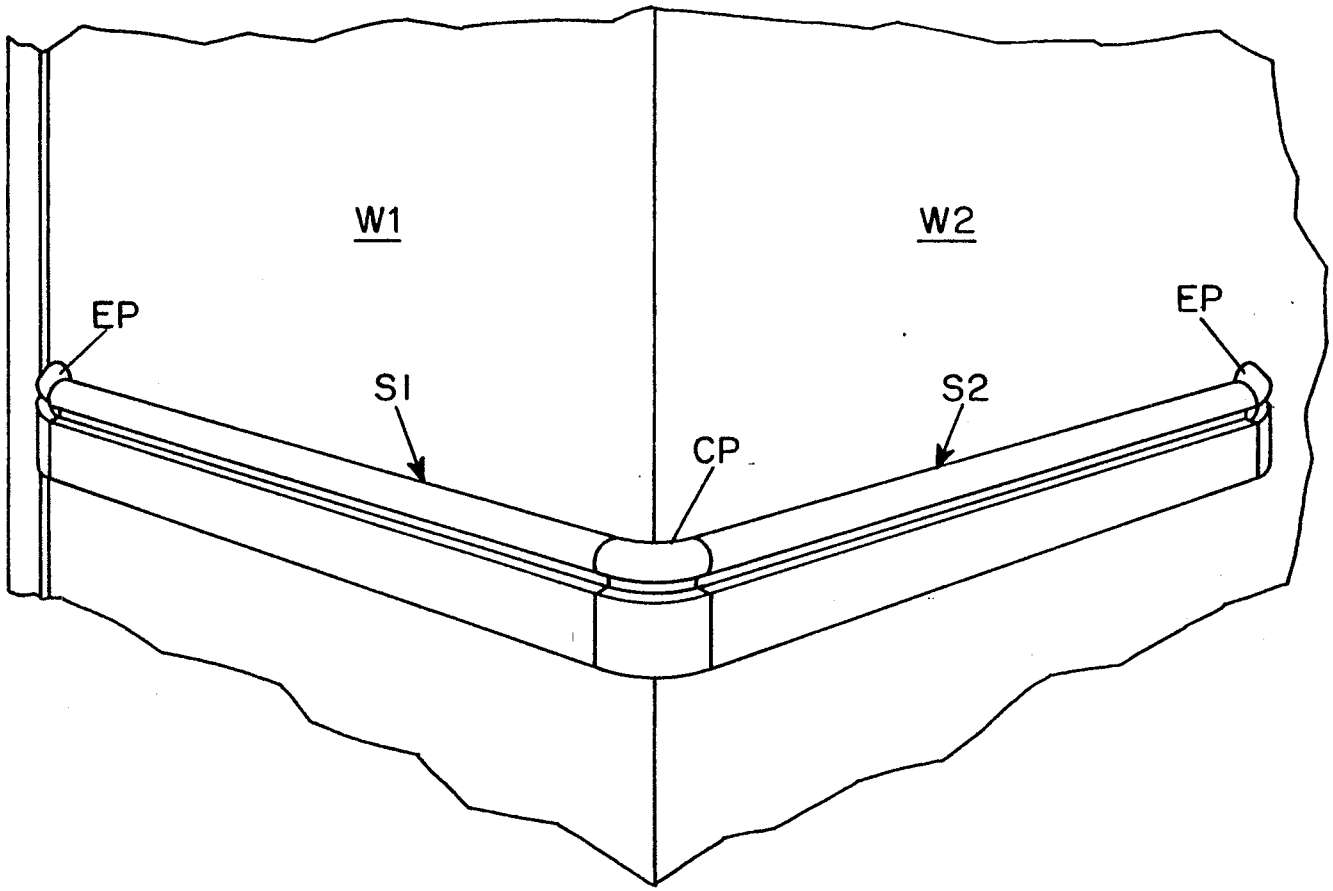
FIG. 1 is a pictorial view of the embodiment, showing it installed on two walls that meet at an external corner.
Figure 2:
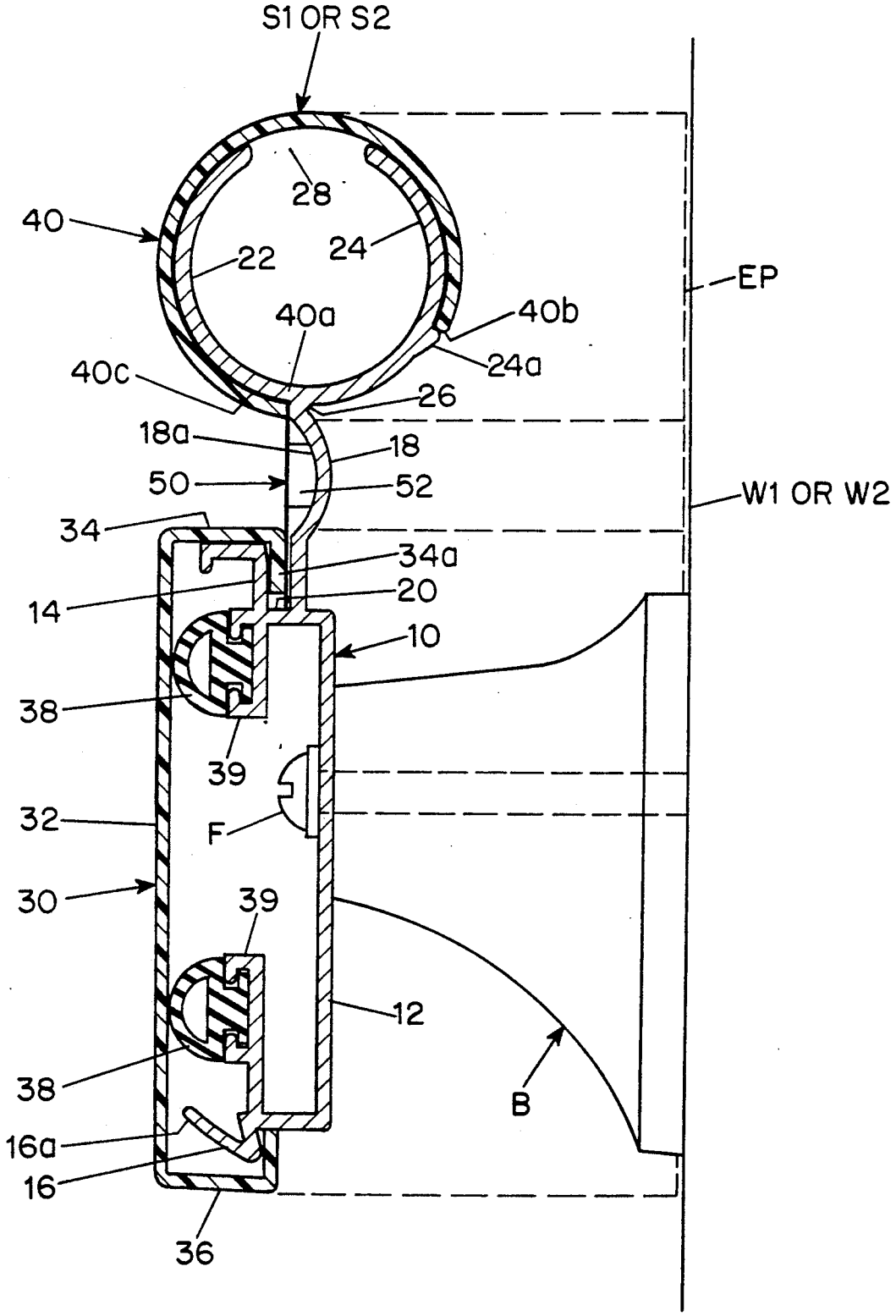
FIG. 2 is an end cross-sectional view of the embodiment.

In the typical installation of a handrail shown in FIG. 1, sections S1 and S2 of the rail assembly are installed at a suitable height along the walls W1 and W2. Molded end pieces EP are fastened to all exposed free ends of the handrail sections and may also be used at ends that occur at external corners. In the illustrated installation, a molded corner piece CP is fastened to the end of each rail section S1 and S2 at the external corner. FIG. 1 is included merely to show the general environment of the invention. Because installations of handrails of the same general type as the present invention are well-known, the various possible installation conditions need not be shown or described. As shown in FIG. 2, each handrail section S1, S2 is mounted on the wall W1, W2 in spaced-apart relation therefrom by means of mounting brackets B by fasteners F at suitable intervals along the length of the rail section.

Each section S1, S2 of the handrail assembly comprises an elongated metal retainer 10 of substantially uniform cross-section along its length and having a channel-shaped body portion 12, upper and lower flange portions 14 and 16 extending upwardly and downwardly, respectively, from the body portion, a web portion 18, which is curved to present a concave front surface 18*a*, extending upwardly from the body portion from a juncture therewith rearwardly of the upper flange portion and defining with the upper flange portion a slot 20 that opens generally upwardly, and front and rear arcuate arm portions 22 and 24 extending upwardly from a common juncture 26 with an upper edge of the web portion and defining the major portion of substantially circular cylindrical surface except for a space 28 between upper edges thereof. The retainer 20 is, preferably, extruded from aluminum, the extrusions being produced in a suitable length for handling and shipping and cut to the length required for the sections required for the job. As is known, per se, rail sections required for the job longer than those that can be conveniently produced and shipped can be provided by splicing two or more rail sub-sections.

An elongated bumper cover member 30 of an impact resistant substantially rigid polymeric material and of substantially uniform cross-section along its length is mounted on the retainer 10. It has a front web portion 32, which is located in spaced-apart relation from and generally in front of the body portion 12 of the retainer, an upper flange portion 34 of substantially L-shaped cross section received in captured engagement by the upper flange portion 14 of the retainer with a return leg part 34*a* thereof received in the slot 20, and a lower flange portion 36 of substantially L-shaped cross section received in captured engagement by the lower flange portion 16 of the retainer. Resilient cushion members 38 are mounted in undercut mounting slots 39 on the retainer and engage the web portion 32 of the bumper cover member.

An elongated handgrip cover member 40 of an impact-resistant substantially rigid polymeric material is received over the upper arm portions 22, 24 of the retainer in substantially continuous contact therewith along mutually engageable internal surfaces of the handgrip cover member and external surfaces of the arm portions of the retainer. The handgrip cover member 40 is substantially tubular except for a space between front and rear edges 40*a* and 40*b*. The rear arm portion 24 of the retainer has a shoulder 24*a* on its external surface. The front edge 40*a* of the handgrip cover member resides closely adjacent the juncture 26 of the web portion 18 of the retainer with the front arm portion 22 of the retainer, and the rear edge 40*b* of the handgrip cover member 40 engages the shoulder 24*a* on the rear arm portion 24 of the retainer.

The cover members 30 and 40 are both, preferably, made by extrusion. A suitable polymeric material for the cover members is a polyvinyl chloride blended with a small amount of an acrylic polymer and incorporating smoke and flame inhibitors that enable it to meet flame spread and smoke development requirements according to recognized standards, such as U.L. ® and A.S.T.M.

The cover members 30 and 40 are sufficiently resilient to enable them the be pressed onto the retainer by hand. In the case of the handrail cover member 40, the space between edges 40*a* and 40*b* at one end is spread apart enough to allow it to be pressed onto the retainer until it begins to pull itself into the final position. It is then simply pushed down progressively along its length. A camming action between the edges 40*a* and 40*b* of the cover member and the convexly curved outer surfaces of the arm portions 22 and 24 facilitates forcing the cover to spread apart. Once it has spread apart enough for the edges to pass a diametrical plane of the arms, the resiliency of the cover enables it to pull itself into final position. End pieces, corner pieces (see FIG. 1) and other terminations, together with a frictional engagement due to slight undersizing of the cover member, keep the cover member in position on the retainer lengthwise. An adhesive may also be used for that purpose. Engagement of the edges 40*a* and 40*b* with the juncture 26 and the shoulder 40*b*, respectively, hold the handrail cover member 40 in position circumferentially.

The bumper cover member also is easily installed on the retainer. The upper flange portion 34 is hooked into the slot 20 along part or all of the length of the retainer, which causes the tip of the inturned leg of the lower flange portion 36 to rest against the lower surface of the curved leg 16*a* of the lower retainer flange portion 16. Next, the lower portion of the front web portion of the cover member is pressed toward the retainer. The leg 36*a* produces a camming action on the lower flange portion of the cover member, guiding it to the lower extremity of the flange portion 16, whereupon it pulls itself into place. The bumper cover member is initially formed such that the flange portions are slightly oblique to the web portion, with the edges of the inturned legs closer together than in the installed condition. Accordingly, the bumper cover member pulls itself into place resiliently with a preload that retains it in place.

The web portion 32 of the bumper cover member 30 is set forward slightly from the frontmost surface of the handrail cover member, with respect to the wall. Accordingly, virtually all impacts of objects against the handrail occur on the bumper cover member, which is better able to sustain them than is the handrail cover member. The bumper cover member is backed up by the cushion members 38, and the web portion is able to deform and deflect, relative to the retainer because of the clearance left between the leg 16*a* and the web portion of the cover member. Accordingly, some of the energy of impacts against the bumper cover member is absorbed by deformation and deflection of the cover member and the cushion members.

Ergonomically, the handrail portion provides an excellent gripping configuration. It is of an almost entirely round cross-section, free of corners and other discontinuities, except for the negligible change from exact roundness at the shoulder 24*a* in the back; the portion of the rear arm portion 24 between the shoulder 24*a* and the juncture 18 substantially matches the curvature of the rest of the handrail portion. In the front, the handrail portion is spaced-apart above the bumper portion by a distance great enough to readily accept the thumbs of persons using the handrail, and the front surface of the web portion is concave for a comfortable fit to a user's thumb.

The nearly continuous engagement circumferentially between the hand rail cover member and the external surfaces of the arm portions 22 and 24 of the retainer provides very strong support for the cover member and enables the handrail to meet the most stringent building standards and codes. Tests of the handrail have established that it can sustain point loads of over 400 pounds in all radial directions, which is far in excess of any present standards and codes.

As an optional feature, the handrail assembly may include a decorative accent strip 50 that is coextensive with the front surface of the web portion of the retainer and in engagement therewith and retained in place by reception of a lower edge portion in the slot 20 and its upper edge in a small groove 40*a* in the arm portion 22 adjacent the juncture 26 thereof with the web portion and by a double-faced adhesive foam band 52. While the strip 50 shown in FIG. 2 is flat, it may, alternatively, be curved to match the shape of the web portion. Flat accent strips can be cut from sheets of polymeric material. Curved strips can be extruded, such as from the same polymeric material as the cover members. When the accent strip is included, the handrail has three members of polymeric material, each of which can be colored to provide a desired decorative effect. One or more of the colors may be part of a color-coding system that identifies regions or pathways of a building. The accent strip may incorporate a fluorescent material that will glow in the dark and provide a visible marking in the event of a lighting failure. The front of the web portion may, on the other hand, be painted or finished by conventional metal treating processes.

I claim:

1. An ergonomic handrail adapted to be mounted on a wall in spaced-apart relation therefrom by means of mounting brackets and comprising an elongated metal retainer of substantially uniform cross-section along its length and having a channel-shaped body portion, upper and lower flange portions extending upwardly and downwardly, respectively, for the body portion, a web portion extending upwardly from the body portion from a junction therewith rearwardly of the upper flange portion and defining with the upper flange portion a slot that opens generally upwardly, and front and rear arcuate arm portions extending upwardly from a common juncture with an upper edge of the web portion and defining the major portion of substantially circular cylindrical surface except for a space between upper edges thereof, an elongated bumper cover member of an impact resistant substantially rigid polymeric material and of substantially uniform cross-section along its length, having a front web portion, an upper flange portion of substantially L-shaped cross section received in captured engagement by the upper flange portion of the retainer with a return leg part thereof received in the slot, and a lower flange portion of substantially L-shaped cross section received in captured engagement by the lower flange portion of the retainer, the bumper cover member being shaped and dimensioned such that the web portion is spaced apart from the frontmost portions of the upper and lower flange portions of the retainer and can deform and deflect for energy absorption upon an impact against the web portion, and an elongated handgrip cover member of an impact-resistant substantially rigid polymeric material received over the upper arm portions of the retainer is substantially continuous contact therewith along mutually engageable internal surfaces of the handgrip cover member and external surfaces of the arm portions of the retainer.

2. An ergonomic handrail according to claim 1 wherein the handgrip cover member is substantially tubular except for a space between front and rear edges, the rear arm portion of the retainer has a shoulder on its external surface, the front edge of the handgrip cover member resides closely adjacent the juncture of the web portion of the retainer with the front arm portion of the retainer and the rear edge of the handgrip cover member engages the shoulder on the rear arm portion of the retainer.

3. An ergonomic handrail according to claim 1 wherein the web portion of the retainer has a concave front surface.

4. An ergonomic handrail according to claim 1 and further comprising at least one resilient cushion member engaged between the retainer and the web portion of the bumper cover member.

5. An ergonomic handrail according to claim 1 and further comprising an accent strip coextensive with the front surface of the web portion of the retainer in engagement therewith.

6. An ergonomic handrail according to claim 5 wherein the accent strip is of a substantially rigid polymeric material and has a lower edge portion received in the slot behind the return leg portion of the upper edge flange portion of the bumper cover member and an upper edge portion received in a groove in the front arm portion of the retainer adjacent the juncture thereof with the web portion.

* * * * *